United States Patent [19]

Tomizu et al.

[11] Patent Number: 4,795,378

[45] Date of Patent: Jan. 3, 1989

[54] TERMINAL PIN

[75] Inventors: Motoyuki Tomizu, Kyoto; Yasuhiro Okada, Takatsuki, both of Japan

[73] Assignee: Omron Tateisi Electronics Co., Kyoto, Japan

[21] Appl. No.: 95,627

[22] Filed: Sep. 14, 1987

[30] Foreign Application Priority Data

Sep. 26, 1986 [JP] Japan ..... 61-147393

[51] Int. Cl.[4] ..... H01R 13/428

[52] U.S. Cl. ..... 439/751; 439/82

[58] Field of Search ..... 439/82, 751, 873, 825–827; 29/845, 874, 882

[56] References Cited

U.S. PATENT DOCUMENTS 4,585,293 4/1986 Czeschka et al. ..... 439/82
4,681,392 7/1987 Terita ..... 439/751
4,691,979 9/1987 Manska ..... 439/82

FOREIGN PATENT DOCUMENTS 3220781 12/1983 Fed. Rep. of Germany ..... 439/751

OTHER PUBLICATIONS

Electrotechnike publication pp. 21 and 22, Feb. 1981.

*Primary Examiner*—Gary F. Paumen
*Attorney, Agent, or Firm*—Foley & Lardner, Schwartz, Jeffery, Schwaab, Mack, Blumenthal & Evans

[57] ABSTRACT

A terminal pin, having a compressed portion the cross section of which is roughly V-shaped, has a pair of arms and a pair of convex contact edges with a concave trail between the convex contact edges. The pair of arms have a uniform thickness and are deformed inwardly when pressed into a through hole defined in a PCB. After being pressed into the through hole, the compressed portion contacts the internal surface of the through hole at four locations, namely, at a pair of external surfaces provided at the ends of the pair of arms and the pair of convex contact edges.

8 Claims, 2 Drawing Sheets

TERMINAL PIN

BACKGROUND OF THE INVENTION

1. Field of the Invention

The invention relates to a terminal pin, and more particularly to a terminal pin which is pressed into a through hole in a printed circuit board (PCB).

2. Related Art

Terminal pins are used, for example, as a wrapping post around which is wound a wire. Such wrapping posts are shown in FIG. 4, wherein pin 1 made of conductive material has a compressed portion 2 which is pressed into a through hole 4 of a PCB 3, so that pin 1 is firmly fixed to the PCB 3. If the compressed portion 2 has a simple square cross section as illustrated in FIG. 4, the compressed portion 2 cannot be properly fitted into through hole 4 due to inaccurate dimensions of through hole 4. Further, only the four corners of portion 2 contact the circular surface of the hole, limiting the electrical contact.

Referring to FIG. 5*a*, compressed portion 2 has a slit 5 between side portions 2*a* and 2*b* which results in a cross section shown in FIG. 5*b* by applying plastic deformation to the compressed portion 2. According to this design the dimensional errors of through hole 4 can be compensated for by elastic deformation of compressed portion 2. However, the compressed portion 2, when inserted, has only two contact points against the circular side of through hole 4. Thus, the rigidness of the cross section is reduced, and compressed portion 2 is easily deformed when it is inserted into a through hole. In addition, the pin 1 is required to have a given dimension in thickness to mold the cross section mentioned above. Accordingly, the design shown in FIG. 5 is not applicable for a PCB with small through holes.

Other cross sections of compressed portions are shown in FIG. 6 and FIG. 7. In FIG. 6 compressed portion 2 has a V-shaped web 2*c* between a pair of flanges which, however, are subject to complicated processing during insertion, thereby resulting in wear of the flanges when pressed into through holes. The structure shown in FIG. 7 has a C-shaped cross section, which has no contacting point against through holes so that pin 1 is subject to rotation after insertion into a through hole when an external torque is applied thereon.

SUMMARY OF THE INVENTION

To solve the above problems, the instant invention provides a terminal pin which can be easily processed by pressing with enough rigidness whereby it will not be readily deformed when inserted.

Another object of the invention is to provide a terminal pin which does not rotate in a through hole when inserted therein even if an external torque is applied.

Still another object of this invention to provide a terminal pin inserted in a through hole having a diameter smaller than the pin.

The invention comprises a terminal pin having a compressed portion the cross section of which is roughly V-shaped and has a pair of arms and a pair of convex contact edges with a concave surface between the convex contact edges. The pair of arms have a uniform thickness and are deformed inwardly when pressed into a through hole defined in a PCB. After being pressed into the through hole, the compressed portion contacts the internal surface of the through hole at four locations, namely, at a pair of external surfaces provided at the ends of the pair of arms and the pair of convex contact edges.

BRIEF DESCRIPTION OF THE DRAWINGS

The above other objects and advantages of the invention will be apparent from the following description and accompanying drawings wherein.

DETAILED DESCRIPTION OF THE PREFERRED EMBODIMENTS

Figure 1:
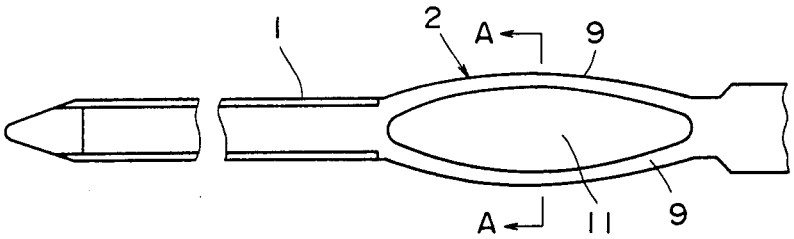
FIG. 1 shows a plan view of a preferred embodiment of the invention.
Figure 2:
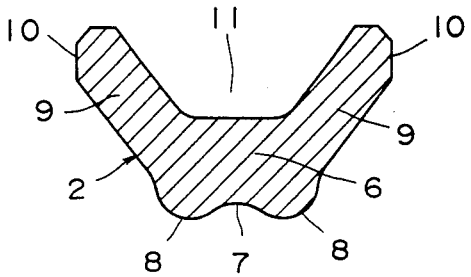
FIG. 2 is an enlarged cross-sectional view of the compressible portion of FIG. 1, taken along lines A—$A_1$.
Figure 3:
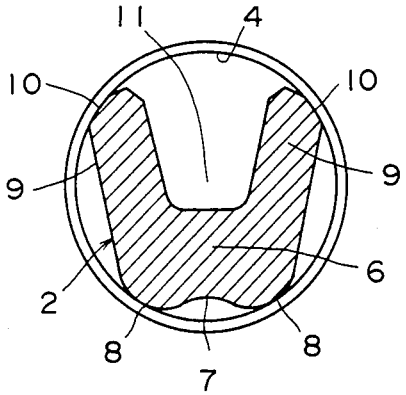
FIG. 3 is a cross-sectional view of the compressed portion inserted into a through hole.
Figure 4:
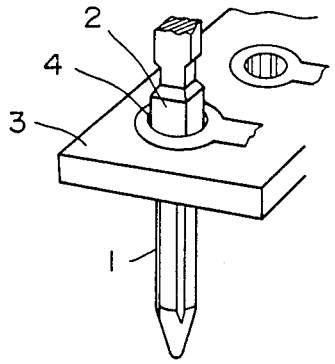
FIG. 4 (Prior Art)
FIG. 4 is a perspective view of prior art which shows how a terminal pin is used with a PCB.
Figure 5A:
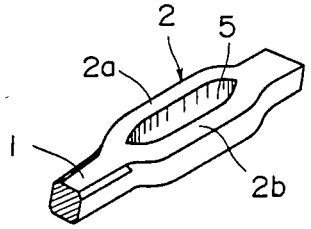
FIG. 5(a)(Prior Art)
FIG. 5*a* is a perspective view of the compressed portion of another prior art pin.
Figure 5B:
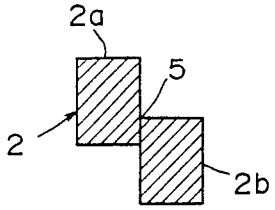
FIG. 5(b)(Prior Art)
FIG. 5*b* is a cross-sectional view of the compressed portion of FIG. 5*a;*
Figure 6:
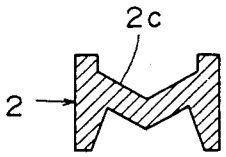
FIG. 6 (Prior Art)
FIG. 6 is a cross-sectional view of a compressed portion of another prior art pin.

Referring to FIGS. 1 and 2, a terminal pin of the invention has a compressible portion 2, the cross section of which is roughly V-shaped having a pair of arms 9 with a substantially uniform thickness and a bottom 6 with a concave surface 7 and a pair of convex contact edges 8. When the compressed portion 2 is pressed into a through hole, a pair of external angled surfaces 10, which are provided at the end of arms 9 and the pair of convex trails 8, are pressed against the internal surface of a through hole 4. When pressed into a through hole, the pair of arms 9 are plastically deformed toward each other, thereby compensating for inaccurate dimensions of the through hole. After insertion, the compressed portion 2 is firmly held in the through hole with its pair of external surfaces 10 and convex contact edges 8 being pressed against the internal surface of through hole 4 as shown in FIG. 3. These four contacting points between the compressed portion 2 and the through hole 4 prevent rotation of the compressed portion 2 in the through hole 4 even if external torque is applied. Further, the pair of convex contact edges 8 and arms 9 improve rigidness against bending and twisting so that pin 1 does not bend at compressed portion 2 when pressed into a through hole of a PCB.

Figure 7:
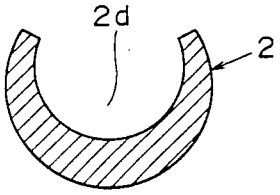
FIG. 7 (Prior Art)
FIG. 7 is a cross-sectional view of a compressed portion of still another related device.

A groove 11 defined between the pair of arms 9 and the concave surface 7 is designed to have a larger dimension at its openings and a smaller dimension at its base, thus making it easier to manufacture molding and enables mass production of small terminal pins for insertion in small through holes. This advantage of easier manufacturing of this embodiment is apparent when compared to the designs shown in FIG. 7 in which a cross section of compressed portion 2 has a groove 2*d* with a large dimensioned bottom and a small dimensioned opening. In addition, the pair of arms 9 have uniform thickness so that stress due to the formation during insertion is spread throughout and prevents wear of arms due to concentrated stresses.

While several embodiments of the invention have been described, it will be understood that it is capable of further modifications, and this application is intended to cover any variations, uses, or adaptations of the invention, following in general the principles of the invention and including such departures from the present disclosure as to come within knowledge or customary practice in the art to which the invention pertains, and as may be applied to the essential features hereinbefore set forth and falling within the scope of the invention or the limits of the appended claims.

What is claimed is:

1. A terminal pin comprising:

(a) a post portion;

(b) a compressible portion extending from said post portion;

(c) said compressible portion being generally V-shaped and formed by a pair of arms and a bottom;

(d) said bottom having a cross-sectional thickness greater than said arms and having a pair of convex contact edges on an outer surface thereof;

(e) said arms being elastically inwardly deformable when the pin is pressed into a through hole, whereby ends of said arms and said convex contact edges contact the through hole.

2. The pin of claim 1 including a concave surface between said convex contact edges.

3. The pin of claim 1 wherein the ends of said arms are angled to permit surface contact with the through hole.

4. The pin of claim 1 wherein said bottom has a generally flat inner surface.

5. The pin of claim 1 wherein said arms have a generally uniform thickness.

6. The pin of claim 1 including a concave surface between said convex contact edges and said arms having a generally uniform thickness, said bottom having a generally flat inner surface and said arms being angled to permit surface contact with the through hole.

7. The pin of claim 1 wherein the bottom crosssectional thickness is substantially greater than said arms.

8. A terminal pin comprising:

(a) a post portion;

(b) a compressible portion extending from said post portion;

(c) said compressible portion being generally V-shaped and formed by a pair of arms having a generally uniform thickness and a bottom;

(d) said bottom having a cross-sectional thickness substantially greater than said arms and having a pair of convex contact edges on an outer surface thereof;

(e) said bottom including a concave surface between said convex contact edges and having a generally flat inner surface;

(f) said arms being elastically inwardly deformable when the pin is pressed into a through hole, whereby ends of said arms and said convex contact edges contact the through hole.

* * * * *